US005154010A

United States Patent [19]

Klemm

[11] Patent Number: 5,154,010

[45] Date of Patent: Oct. 13, 1992

[54] SHEET DRYING APPARATUS

[75] Inventor: Gerhard Klemm, Bielefeld, Fed. Rep. of Germany

[73] Assignee: Gerhard Klemm Maschinenfabrik GmbH & Co., Bielefeld, Fed. Rep. of Germany

[21] Appl. No.: 602,472

[22] Filed: Oct. 24, 1990

[30] Foreign Application Priority Data

Nov. 6, 1989 [DE] Fed. Rep. of Germany ..... 3936958

[51] Int. Cl.[5] ..... F26B 19/00

[52] U.S. Cl. ..... 34/216; 34/217; 34/68

[58] Field of Search ..... 34/4, 41, 68, 216, 217, 34/162; 432/227

[56] References Cited

U.S. PATENT DOCUMENTS

| | | | |
|---|---|---|---|
| 2,651,849 | 9/1954 | Kisskalt | 34/216 X |
| 3,254,426 | 6/1966 | Lamb et al. | 34/216 X |
| 3,319,353 | 5/1967 | Matsunami et al. | 34/162 X |
| 3,359,648 | 12/1967 | Overly et al. | 34/162 X |
| 3,987,556 | 10/1976 | Tissot et al. | 34/162 X |
| 4,015,103 | 3/1977 | Cherian | 432/227 X |
| 4,597,192 | 7/1986 | Sfondrini et al. | 34/216 X |
| 4,905,381 | 3/1990 | Poterala | 34/158 X |

*Primary Examiner*—Henry A. Bennet
*Assistant Examiner*—Christopher B. Kilner
*Attorney, Agent, or Firm*—Peter K. Kontler

[57] ABSTRACT

A sheet drying apparatus wherein the horizontal upper reach of an endless foraminous conveyer transports a series of sheets to be dried between a main suction chamber below and a plenum chamber above the upper reach. The drying station between the two chambers is flanked by two additional suction chambers which extend transversely of the direction of advancement of sheets and serve to attract the sheets to the upper side of the upper reach of the conveyor. A blower is provided to draw air from the main suction chamber and to admit the withdrawn air into channels for admission into the plenum chamber. The sheets are directly or indirectly heated by a stationary heating device between the main plenum chamber and the upper reach of the conveyor, by one or more heating elements in the plenum chamber, by heating elements in the main suction chamber and by heating elements in the channels. The main suction chamber is installed in a housing which also supports the conveyor and some of the channels, and the plenum chamber is provided in a hood which is pivotably connected to the housing. Sheets to be dried are fed onto the conveyor upsteam of the additional suction chamber which is located ahead of the drying station, and dried sheets are collected in a chute which is disposed at the discharge end of the conveyor adjacent the additional suction chamber which is located downstream of the drying station.

18 Claims, 2 Drawing Sheets

SHEET DRYING APPARATUS

BACKGROUND OF THE INVENTION

The invention relates to sheet drying apparatus in general, and more particularly to improvements in apparatus for drying short or long series of successive sheets which are transported by a conveyor through one or more drying stations. Still more particularly, the invention relates to improvements in sheet drying apparatus of the type wherein the sheets are transported by a foraminous conveyor to advance above a stationary heating device and a stationary suction chamber.

Sheet heating apparatus which employ a foraminous conveyor, a stationary heating device and a stationary suction chamber are disclosed in commonly owned U.S. Pat. No. 4,619,050 granted Oct. 28, 1986 to Klemm and in German Pat. No. 26 07 504. The patented apparatus can be utilized with advantage to reduce the moisture content of sheets which issue from a printing machine, e.g., a screen printing machine. A drawback of presently known sheet drying apparatus is that they cannot satisfactorily treat moisture-containing sheets which issue from a high-speed printing machine. Moreover, presently known sheet drying apparatus are not sufficiently accident proof to meet the safety rules and regulations in certain countries. Still further, presently known drying apparatus cannot invariably reduce the moisture content of sheets in such a way that the quality of the dried products is not affected by the drying action, especially if the sheets are to be dried at a high or very high frequency.

OBJECTS OF THE INVENTION

An object of the invention is to provide an apparatus which can satisfactorily treat sheets irrespective of the frequency at which the sheets are being supplied thereto.

Another object of the invention is to provide an apparatus which is capable of preventing the escape of appreciable quantities of noxious or other undesirable substances into the surrounding atmosphere.

A further object of the invention is to provide a simple and compact apparatus which is safer than heretofore known sheet drying apparatus even though its output at least matches and can considerably exceed the output of conventional apparatus.

An additional object of the invention is to provide an apparatus which can be utilized with particular advantage to reduce the moisture content of sheets carrying chemicals which are capable of affecting the comfort and/or health of the attendants.

Still another object of the invention is to provide the apparatus with novel and improved means for circulating air to and from the commodities at the drying station or stations.

A further object of the invention is to provide an apparatus wherein all such parts which require frequent maintenance, repair, replacement or inspection are readily accessible to one or more attendants without necessitating even partial dismantling of the apparatus.

An additional object of the invention is to provide the apparatus with novel and improved means for preventing undesirable shifting and/or deformation of sheets on their way toward, through and beyond one or more drying stations.

Another object of the invention is to provide the apparatus with novel and improved means for confining evaporable substances at the drying station or stations.

A further object of the invention is to provide a novel and improved method of reducing the moisture content of sheets which are discharged by a printing machine.

An additional object of the invention is to provide a novel and improved method of circulating air and evaporated moisture and/or other evaporable substances in the above outlined apparatus.

SUMMARY OF THE INVENTION

The invention resides in the provision of an apparatus for drying sheet-like commodities (hereinafter called sheets for short). The improved apparatus comprises means for transporting sheets in a predetermined direction along a predetermined path (preferably along a substantially horizontal path) and including a foraminous conveyor (e.g., an apertured endless belt or band conveyor), at least one first suction chamber which is adjacent the conveyor beneath a first portion of the path, at least one plenum chamber above the first portion of the path, means for heating the sheets in the first portion of the path, and at least one sheet-attracting second suction chamber adjacent the conveyor beneath a second portion of the path upstream of the first portion.

The heating means can include an apertured plate-like heating element between the at least one first suction chamber and the conveyor at the first portion of the path.

The at least one second suction chamber is preferably elongated and extends transversely of the predetermined direction.

The apparatus can further comprise at least one sheet-attracting third suction chamber adjacent the conveyor beneath a third portion of the path downstream of the first portion. The at least one second and/or the at least one third suction chamber is or can be closely adjacent the first portion of the path for the sheets to be dried.

The apparatus preferably further comprises a housing below and a mobile (preferably pivotable) cover or hood above the path for the sheets. The at least one first suction chamber is provided in the housing, and the at least one plenum chamber is provided in the hood. The plenum chamber can comprise an air heater and nozzles which serve to direct heated air against sheets in the first portion of the path. The heating means is also provided in the housing, and the latter is preferably designed to support the foraminous conveyor.

An air evacuating device is provided in or on the housing to draw air from the at least one first suction chamber (and preferably also from the at least one second and/or the at least one third suction chamber), and such apparatus preferably further comprises means for conveying air from the evacuating device into the at least one plenum chamber. The conveying means can be constructed and mounted in such a way that it includes a first portion in the housing and a second portion in the hood.

The apparatus can further comprise means for heating air in the at least one first suction chamber and/or in the conveying means.

The housing is preferably constructed in such a way that it includes a first section beneath a first section of the hood and a second section beneath a second section of the hood. The at least one first suction chamber is disposed in the first section of the housing, and the at least one plenum chamber is disposed in the first section of the hood. The conveying means is designed to convey air from the evacuating means to the at least one plenum chamber by way of the second section of the housing and the second section of the hood. The first section of the housing can be rigid (e.g., integral) with the second section, and the same holds true for the first and second sections of the hood.

The apparatus can further comprise means (e.g., a substantially horizontal table) for supporting a portion of the conveyor upstream of the at least one second suction chamber, and such portion of the conveyor preferably serves to receive a series of sheets to be dried. The sheets can be supplied by hand or by a suitable sheet feeding device or machine.

The conveyor has a discharge end for dried sheets downstream of the first portion of the path (namely downstream of the at least one third suction chamber), and the apparatus preferably further comprises a receptacle for dried sheets. Such receptacle is installed at the discharge end of the conveyer and can include a chute.

The at least one second suction chamber and/or the at least one third suction chamber can have a polygonal (particularly square or rectangular) cross-sectional outline.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
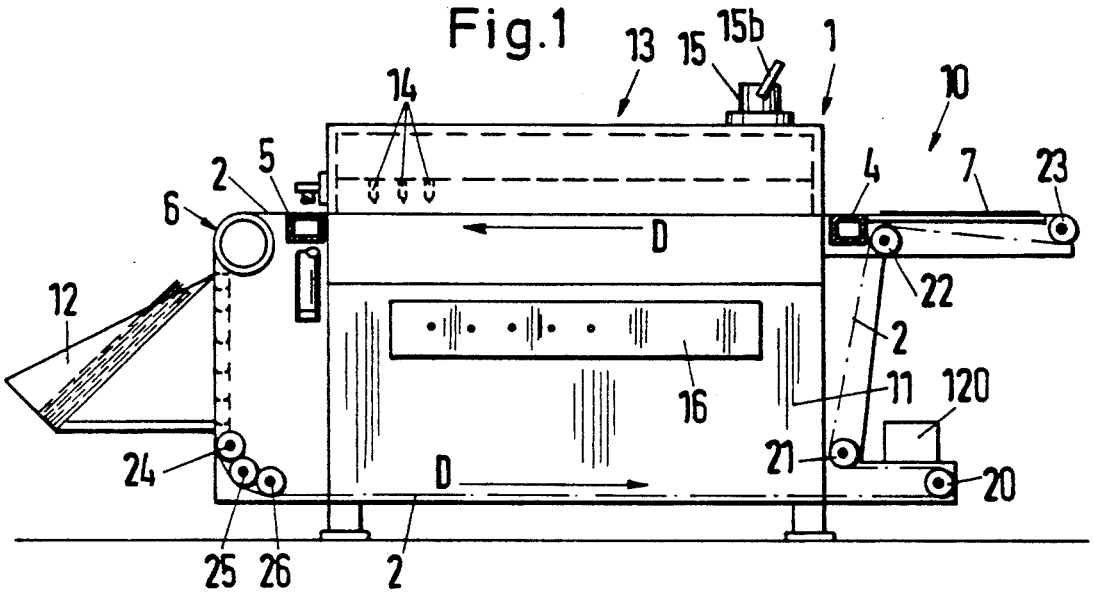
FIG. 1 is a somewhat schematic front elevational view of a sheet drying apparatus which embodies one form of the invention.
Figure 2:
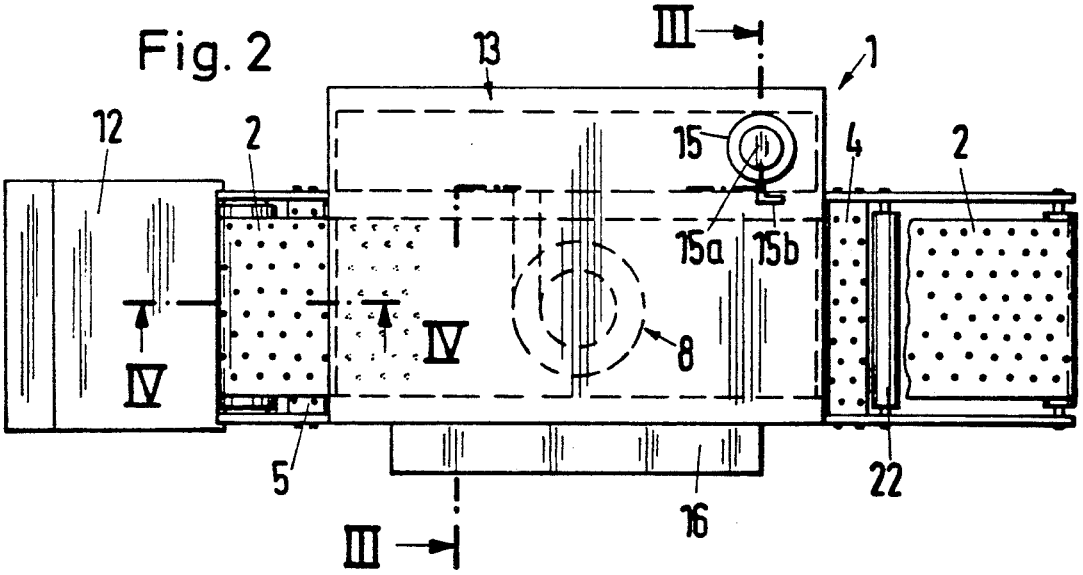
FIG. 2 is a plan view of the apparatus which is shown in FIG. 1, a portion of the upper reach of the conveyor being broken away.
Figure 3:
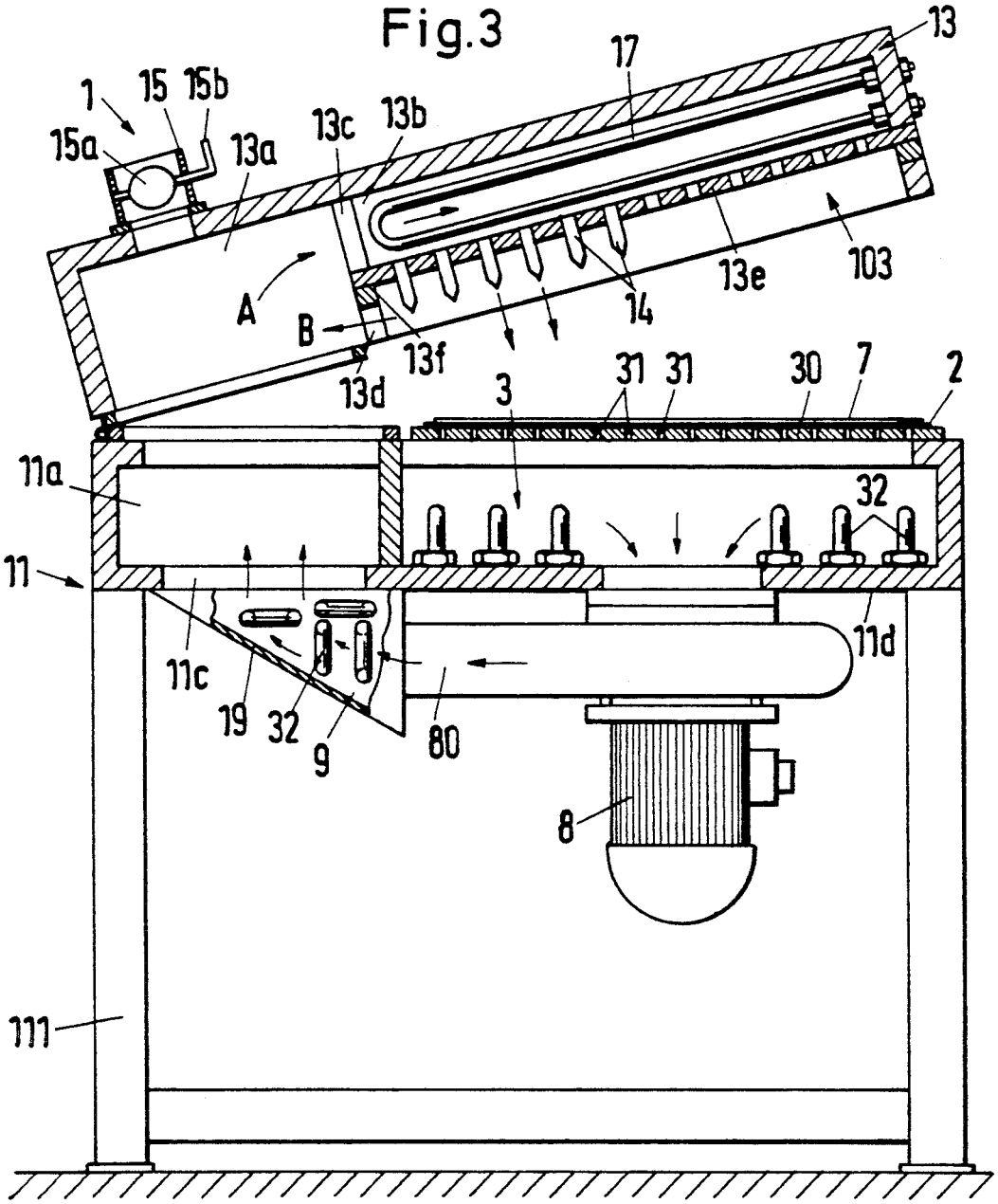
FIG. 3 is an enlarged transverse vertical sectional view substantially as seen in the direction of arrows from the line III—III in FIG. 2, the hood being shown in partly open position.

The sheet drying apparatus 1 which is shown in FIGS. 1 to 3 can be installed at the discharge end of a production line, e.g., downstream of a high-speed printing machine which discharges a series of imprinted sheets 7. Alternatively, the apparatus 1 can be positioned to receive a series of sheets 7 from a coating or a like machine which applies to sheets decorative matter, information and/or any other matter containing moisture which is to be expelled before the sheets can be properly stacked or otherwise processed. One of the presently preferred uses of the apparatus 1 is for drying sheets which are discharged by a screen printing machine.

The apparatus 1 comprises a housing 11 beneath and a pivotable hood 13 above an elongated horizontal path for the sheets 7. Such sheets are supplied onto the horizontal upper reach of an endless foraminous belt conveyor 2 which forms part of a sheet transporting unit and is carried by the housing 11. A portion of the upper reach of the conveyor 2 is supported by a horizontal table 10 which is mounted on the housing 11 upstream of the hood 13 (as seen in the direction (arrows D) of advancement of sheets 7 along the horizontal path. Dried sheets 7 are collected in a receptacle 12 which is adjacent the discharge end of the conveyor 2, namely downstream of the housing 11 and hood 13. The illustrated receptacle 12 is a chute which can gather a given number of dried sheets 7 before the accumulated stack of dried sheets is removed by hand or in any other suitable way.

The hood 13 cooperates with the housing to define a space which is at least substantially sealed from the surrounding atmosphere and wherein the sheets 7 are relieved of surplus moisture during advancement through at least one drying station between a first or main suction chamber 3 in the housing 11 and a plenum chamber 103 in the hood 13. The means for drying sheets 7 between the chambers 3 and 103 (when the hood 13 is maintained in the closed position of FIG. 1) comprises a plate-like horizontal heating element 30 which is disposed between the chamber 3 and the upper reach of the conveyor 2 and is provided with holes 31 or other apertures so as to enable some air and some moisture to flow from the chamber 103 into the chamber 3 when the apparatus 1 is in actual use.

The plenum chamber 103 comprises or contains at least one coiled or meandering air heating element or air heater 17 (e.g., an electric resistance heater) and a plurality of nozzles 14 which serve to direct heated air against the upper sides of sheets 7 on the upper reach of the conveyor 2. The nozzles 14 are mounted in a horizontal partition **13*e* of the hood 1. This partition divides the front section of the hood 13 into an upper compartment 13*b* for the heating element 17 and a lower compartment for heated air streams or jets issuing from the orifices of the nozzles 14. The suction chamber 3 is provided in the front section of the housing 11, and such front section further supports the table 10, the receptacle 12, and the conveyor 2. The latter is trained over a number of pulleys 20, 21, 22, 23, 24, 25, 26 and a hollow pulley 6 having a foraminous cylindrical wall and being connected to a suction generating air evacuating device 8 on the housing 11. Thus, the pressure in the interior of the pulley 6 is below atmospheric pressure so that the peripheral surface of the pulley 6 attracts the adjacent portion of the conveyor 2. At least one of the pulleys (e.g., the pulley 20) is driven by an electric stepping motor 120 or by another suitable prime mover to advance the conveyor 2** in the direction of arrows D.

In accordance with a feature of the invention, the apparatus 1 further comprises at least one second suction chamber 4 which is located immediately upstream of the (first) path portion between the chambers 3 and 103. The suction chamber 4 includes an elongated beam which has a foraminous top wall directly abutting the underside of the upper reach of the foraminous conveyor 2. The beam extends transversely of the direction which is indicated by the arrows D and its internal space is evacuated by the suction generating device 8. The illustrated second suction chamber 4 has a rectangular cross-sectional outline; however, it is equally within the purview of the invention to employ one or more suction chambers 4 having a square or other cross-sectional outline.

The conveyor 2 can be made of a heat-resistant material, e.g., a textile material which is woven, perforated, knitted or otherwise shaped to exhibit interstices for the passage of air and moisture. Such interstices enable the suction chamber 4 to attract successive sheets 7 to the upper side of the upper reach of the conveyor 2 immediately ahead of the drying station between the housing 11 and the hood 13 to thus prevent undesirable shifting of sheets on their way into the range of the main suction chamber 3 which attracts the sheets to the upper reach of the conveyor 2 by way of apertures 31 in the heating element 30 and by way of interstices in the conveyor The suction chamber 4 is affixed to the exterior of the housing 11 and/or to the underside of the table 10, preferably immediately upstream of the silt where the upper reach of the conveyor 2 and the sheets 7 thereon enter the drying station beneath the plenum chamber 103.

Figure 4:
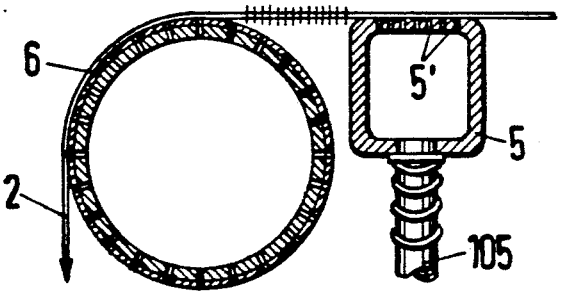
FIG. 4 is an enlarged fragmentary vertical sectional view substantially as seen in the direction of arrows from the line IV—IV of FIG. 2.

A third suction chamber 5 is located directly beneath the upper reach of the conveyor 2 immediately downstream of the drying station between the chambers 3 and 103. The suction chamber 5 is or can be identical with the suction chamber 4, i.e., it can resemble an elongated beam having a rectangular, square or other suitable cross-sectional outline and having its internal space connected to the suction generating device 8. The suction chamber 5 ensures that the position of freshly dried sheets 7 relative to the conveyor 2 cannot change while such sheets advance toward and along the hollow pulley 6 on their way toward and into the receptacle 12. The foraminous belt conveyor 2 directly abuts the air-permeable top wall of the suction chamber 5 as well as the apertures in the hollow pulley 6. This can be seen in FIG. 4 wherein the apertures in the top wall of the suction chamber 5 are denoted by the reference numeral 5'. A flexible conduit 105 is provided to connect the internal space of the suction chamber 105 with the suction intake of the suction generating device 8 on the housing 11. A similar conduit (not specifically shown) is provided to connect the suction intake of the suction generating device 8 with the internal space of the suction chamber 4.

The apparatus 1 can be equipped with two or more suction chambers 3, with two or more plenum chambers 103, with two or more suction chambers 4 and/or with two or more suction chambers 5.

The suction chamber or chambers 4 ensure that successive moisture-containing sheets 7 enter the drying station without fluttering or other undesirable stray movements and can be dried during advancement between the heating element 30 and the nozzles 14 in a highly predictable manner. Heat which is supplied by the element 30 is radiated through the adjacent portion of the upper reach of the conveyor 2 and, at the same time, a sheet 7 above the heating element 30 is relieved of moisture by streams or jets of hot air issuing from the nozzles 14 in the plenum chamber 103. Hot air which issues from the nozzles 14 blows away moisture and vapors which are expelled from successive sheets 7 advancing along and over the heating element 30. Expulsion of moisture and vapors is highly predictable because each sheet 7 which advances toward, through and beyond the drying station between the front sections of the housing 11 and hood 13 is attracted by suction all the way from the table 10 to the receptacle 12, first by one or more suction chambers 4, thereupon by one or more suction chambers 3, thereupon by one or more suction chambers 5 and ultimately by the hollow pulley 6. Such mode of transporting ensures that a sheet 7 which has been advanced into the range of the illustrated suction chamber 4 does not move relative to the conveyor 2 all the way to the discharge end of this conveyor, i.e., to the point where it is free to descend into the receptacle 12. Moreover, each sheet 7 is flat during travel toward, through and beyond the drying station; this also contributes to predictable expulsion of moisture from each sheet of a short or long series of successive sheets.

The stepping motor 120 can be replaced by or used alternatingly with a (non-illustrated) motor which is capable of continuously driving the conveyor 2 at a selected speed. It is presently preferred to advance the conveyor 2 in stepwise fashion. Instead of driving the pulley 20, the motor 120 can be mounted to drive the hollow pulley 6. Such pulleys are known from the art of printing machines. Reference may be had, for example, to commonly owned U.S. Pat. No. 4,628,814 granted Dec. 16, 1986 to Klemm.

The upper reach constitutes a relatively small portion of the conveyor 2. The major portion of this conveyor (extending from the pulley 6 to the pulley 23) permits repeated regeneration or discharging of successive increments before they reach the table 10 to be overlapped by a freshly supplied sheet 7.

The reference character 16 denotes a control panel at the front side of the housing 11. This control panel is provided with means for regulating the operation of the suction generating device 8, motor 120 and various heating elements.

FIG. 3 snows that the chambers 3 and 103 are located in the front sections of the housing 3 and hood 13, respectively. The front section of the housing 11 carries the suction generating device 8 which serves to evacuate air from the suction chamber 3 and has an outlet 80 which discharges evacuated air into a system of air conveying channels in the rear sections of the housing 11 and hood 13. A channel **11*a* in the rear section of the housing 11 receives air from the outlet 80 of the suction generating device 8 by way of a channel or duct 9 which is bounded from below by an inclined bottom wall 19 and contains one or more heating elements 32 for the conveyed air stream. The channels 9, 11*a* communicate by way of one or more openings 11*c* in a horizontal wall 11*d* of the housing 11**.

A channel **13*a* in the rear section of the hood 13 receives air from the channel 11*a* and admits such air into the upper compartment 13*b* of the plenum chamber 103 by way of an opening 13*c* in a vertical partition 13*f* between the front and rear sections of the hood 13. The direction of air flow from the channel 13*a* into the compartment 13*b* is indicated by an arrow A. An arrow B indicates the direction of flow of surplus air from the lower compartment of the plenum chamber 103 back into the channel 13*a*. To this end, the partition 13*f* has a second opening 13*d* beneath the partition 13*e*. Streams or jets of air which issue from the orifices of the nozzles 14 in the lower compartment of the plenum chamber 103 serve to expel moisture from sheets 7 on the upper reach of the conveyor 2 as well as to urge the sheets against the upper reach in order to ensure predictable expulsion of moisture and vapors from the entire sheet which is in the process of advancing through the drying station. It is preferred to provide the plenum chamber 103 with a large number of nozzles 14 which are or can be uniformly distributed in the partition 13*e***.

Additional heating elements 32 are provided in the suction chamber 3 to heat air which flows toward the suction generating device 8 and/or to heat the plate-like heating element 30. Similar or other types of heating elements can be provided in the channel 13*a* in the rear section of the hood 13.

Spent air can be evacuated from the channel 13*a* by way of a valve 15 having a flap 15*a* which is pivotable by a handle 15*b* to permit regulation of the rate of evacuation of spent air into the atmosphere or into a collecting chamber, not shown.

The wall 11*d* of the housing 11 is mounted on several legs 111. This wall carries the channel or duct 9 as well as the suction generating device 8. If the apparatus 1 is to be used for expulsion of excess moisture from relatively large (e.g., long) sheets, the housing 11 can confine two or more main suction chambers 3 which are disposed end to end (as seen in the direction of arrows D) and each of which can be connected with a discrete suction generating device.

The feature that air is free to circulate along an endless path which is defined by the housing 11 and hood 13 is desirable and advantageous because this renders it possible to achieve substantial savings in energy for heating the air.

That portion of the bottom wall 11*d* of the housing 11 which is provided with the opening or openings 11*c* can be omitted, i.e., the channel 11*a* can extend all the way to the outlet 80 of the suction generating device 8.

The hood 13 cooperates with the housing 11 to practically completely seal the path for circulation of air from the surrounding atmosphere. As a rule, air can escape (in a controlled manner) only by way of the valve 15 at a rate which is determined by the selected orientation of the flap 15*a*. This ensures that the surrounding area cannot be contaminated by vapors which are expelled from the sheets 7 during advancement through the drying station between the chambers 3 and 103.

The hollow pulley 6 can be operated discontinuously in a manner well known from the art of screen printing machines. However, it is equally possible to switch to continuous operation of the pulley 6 without departing from the spirit of the invention.

The pivotable hood 13 renders it possible to gain access to the drying station with little loss in time.

The improved apparatus 1 is capable of processing a large number of sheets per unit of time even though its space requirements are surprisingly small.

Reliable retention of sheets in their path is particularly important if the sheets are very thin and should not be creased and/or otherwise deformed during advancement toward, through and beyond the drying station. Moreover, reliable retention of sheets by pneumatic means renders it possible to advance the sheets at a high speed to thus reduce the length of intervals which are necessary to expel moisture and/or other evaporable constituents of sheets 7 which are deposited on the conveyor portion above the table 10.

The improved apparatus renders it possible to treat sheets which issue from a screen printing machine wherein the sheets are provided with printed matter containing certain constituents which cause a so-called "working" of dried sheets if they are permitted to remain in longer-lasting contact with the sheets subsequent to drying. The aforediscussed means for circulating air along an endless path which is defined by the housing 11 and hood 13 ensures that the duration of contact between the sheets 7 and the moisture which is contained in printing ink is very short. Heretofore known attempts to avoid such "working" of sheets which contain or carry printing ink include the establishment of long paths for gradual drying of the sheets. This necessitates the utilization of long drying apparatus and the provision of expensive means for segregating expelled moisture from the sheets.

The sheets 7 can constitute printed circuit foils which are discharged from a screen printing machine. The applied air acts primarily and can appreciably support the diffusion forces of the coloring agent. The diffusion forces are further assisted by heat which is applied from below by the heating element 30 because a sheet at the drying station permits the transfer of heat but is not permeable to air. Were the air permitted to penetrate through a sheet 7 above the heating element 30, such air could interfere with the evaporation of moisture from the printed matter which was applied in the screen printing machine. Evaporation of moisture takes place in the plenum chamber 103, and suction in the chamber 3 acts upon the underside of a sheet 7 above the heating element 30. Such suction ensures that the sheet 7 adheres to the upper side of the upper reach of the conveyor 2 and shares all movements of the upper reach toward the suction chamber 5.

It has been found that highly satisfactory drying of sheets 7 at a high frequency and in a small area can be achieved if the following requirements are satisfied:

(1) Heated air should be blown (by nozzles 14 or equivalent means) against the ink-carrying upper side of a sheet 7 above the heating element 30 in order to prevent excessive saturation of air above the sheet with moisture and/or other evaporated substances, to reach and to penetrate through the developed boundary layers as well as to bring about a drying action upon the sheet.

(2) The drying action should be assisted by supplying contact heat from below (i.e., by the upper reach of the conveyor 2 which is in contact with the heating element 30). Such contact heat acts upon the sheets 7 from below and facilities the evaporation of moisture and/or other evaporable substances.

(3) The sheets should be attracted to the upper side of the upper reach of the conveyor 2 not only in the region between the chambers 3, 103 but also at least on their way toward these chambers, i.e., in the region of one or more suction chambers 4 closely ahead of the drying station. It is further desirable and advantageous to prevent any or any appreciable stray movements of freshly dried sheets on their way toward the receptacle 12; this is accomplished by the provision of one or more suction chambers 5 which are closely adjacent the drying station and are located downstream of the chambers 3, 103. The chambers 4, 5 cooperate with the chamber 3 as well as with the jets of air issuing from the nozzles 14 to ensure that the sheets 7 remain free of wrinkles all the way between the table 10 and the receptacle 12.

The improved apparatus 1 can satisfy all of the above requirements in a highly efficient manner. Thus, the sheets are held against fluttering, bulging and/or other kinds of deformation, they advance along their prescribed path, the drying action is uniform in each and every part of a sheet 7 between the chambers 3, 103, and the outlines of printed matter which has been applied in a screen printing or other sheet supplying machine are sharp.

The improved apparatus is susceptible of many additional modifications. For example, the suction chamber 4 and/or 5 can be assembled of two or more discrete suction chambers which are disposed end to end and jointly extend across the full width of the conveyor 2. Moreover, the apparatus can employ other types of means for heating the plate-like element 30 and/or the air in the plenum chamber 3, in the plenum chamber 103 or in the air conveying channels 9, 11*a* and 13*a*. The configuration of the suction chamber 4 and/or 5 can depart from that which is shown in FIG. 5 but the provision of suction chambers which can lie flat against the underside of the conveyor 2 immediately upstream and immediately downstream of the drying station is preferred at this time because such suction chambers ensure that the sheets 7 are attracted to the upper side of the upper reach of the conveyor 2 in a highly predictable manner.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for drying sheets, comprising means for transporting sheets in a predetermined direction along a predetermined path, including a foraminous conveyor; at least one first suction chamber adjacent said conveyor beneath a first portion of said path; at least one plenum chamber above said first portion; at least one sheet-attracting second suction chamber adjacent said conveyor beneath a second portion of said path upstream of said first portion; and means for heating the sheet in the first portion of said path; a housing below and a mobile hood above said path, said housing including a first section and a second section and said hood comprising a first section above the first section of said housing and a second section above the second section of said housing, said at least one first suction chamber being disposed in the first section of said housing and said at least one plenum chamber being disposed in the first section of said hood; and means for conveying air from said at least one first suction chamber to said at least one plenum chamber, said conveying means being disposed in said second sections.

2. The apparatus of claim 1, wherein said heating means includes an apertured plate-like heating element between said at least one first suction chamber and the conveyor at said first portion of said-path.

3. The apparatus of claim 1, wherein said at least one second suction chamber is elongated and extends transversely of said predetermined direction.

4. The apparatus of claim 1, further comprising at least one sheet-attracting third suction chamber adjacent said conveyor beneath a third portion of said path downstream of said first portion.

5. The apparatus of claim 4, wherein said at least one third suction chamber is closely adjacent said first portion of said path.

6. The apparatus of claim 1, wherein said at least one second suction chamber is closely adjacent said first portion of said path.

7. The apparatus of claim 1, wherein said plenum chamber comprises an air heater and nozzles arranged to direct heated air against sheets in said first portion of said path.

8. The apparatus of claim 1, wherein said heating means is provided in said housing and said conveyor is supported by said housing.

9. The apparatus of claim 1, further comprising means for evacuating air from said at least one first suction chamber and for supplying evacuated air to said conveying means.

10. The apparatus of claim 9, wherein said evacuating means is supported by said housing conveying means includes a first portion in said housing and a second portion in said hood.

11. The apparatus of claim 9 further comprising means for heating air in said conveying means.

12. The apparatus of claim 1, wherein said heating means comprises means for heating air in said at least one first suction chamber.

13. The apparatus of claim 1, further comprising means for evacuating air from said suction chambers.

14. The apparatus of claim 1, wherein at least one of said first sections is rigid with the respective second section.

15. The apparatus of claim 1, further comprising means for supporting a portion of said conveyor upstream of said at least one suction chamber, said portion of said conveyor being arranged to receive sheets to be dried in said first portion of said path.

16. The apparatus of claim 1, wherein said conveyor has a discharge end downstream of said first portion of said path and further comprising a receptacle for dried sheets at said discharge end.

17. The apparatus of claim 16, wherein said receptacle includes a chute.

18. The apparatus of claim 1, wherein said at least one second suction chamber has a polygonal cross-sectional outline.

* * * * *